US007560039B2

(12) United States Patent
Krawczyk et al.

(10) Patent No.: US 7,560,039 B2
(45) Date of Patent: Jul. 14, 2009

(54) METHODS OF DEEP REACTIVE ION ETCHING

(75) Inventors: John W. Krawczyk, Richmond, KY (US); Andrew L. McNees, Lexington, KY (US); James M. Mrvos, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 735 days.

(21) Appl. No.: 10/938,009

(22) Filed: Sep. 10, 2004

(65) Prior Publication Data

US 2006/0054590 A1 Mar. 16, 2006

(51) Int. Cl.
*B41J 2/16* (2006.01)

(52) U.S. Cl. ..... 216/27; 216/41; 216/49; 216/56; 216/67; 216/79; 430/320

(58) Field of Classification Search ..... 216/2, 216/27, 47, 56, 71, 79
See application file for complete search history.

(56) References Cited

U.S. PATENT DOCUMENTS

| | | | | | |
|---|---|---|---|---|---|
| 4,066,491 | A * | 1/1978 | Ruh et al. | ..... | 216/27 |
| 4,522,681 | A | 6/1985 | Gorowitz et al. | | |
| 4,957,592 | A * | 9/1990 | O'Neill | ..... | 216/2 |
| 5,077,565 | A | 12/1991 | Shibaike et al. | | |
| 5,201,987 | A * | 4/1993 | Hawkins et al. | ..... | 216/2 |
| 5,385,635 | A * | 1/1995 | O'Neill | ..... | 216/27 |
| 5,403,435 | A | 4/1995 | Cathey et al. | | |
| 5,738,757 | A * | 4/1998 | Burns et al. | ..... | 438/603 |
| 5,772,906 | A | 6/1998 | Abraham | | |
| 5,980,762 | A * | 11/1999 | Otani et al. | ..... | 216/2 |
| 6,033,588 | A | 3/2000 | Yu | | |
| 6,142,607 | A | 11/2000 | Takata et al. | | |
| 6,405,934 | B1 * | 6/2002 | Hess et al. | ..... | 239/4 |
| 6,409,312 | B1 * | 6/2002 | Mrvos et al. | ..... | 347/54 |
| 6,631,558 | B2 | 10/2003 | Burgess | | |
| 6,662,448 | B2 | 12/2003 | Kubby et al. | | |
| 6,672,629 | B2 | 1/2004 | Tai et al. | | |
| 6,723,250 | B1 * | 4/2004 | Schaefer et al. | ..... | 216/2 |
| 2004/0132855 | A1 * | 7/2004 | Kohl et al. | ..... | 522/150 |
| 2004/0246292 | A1 * | 12/2004 | Hashimoto et al. | ..... | 347/20 |
| 2006/0054592 | A1 * | 3/2006 | Krawczyk et al. | ..... | 216/27 |

FOREIGN PATENT DOCUMENTS

| | | | |
|---|---|---|---|
| EP | 0 871 213 | A2 | 10/1998 |
| EP | 1 005 917 | A1 | 6/2000 |
| EP | 1 273 355 | A1 | 1/2003 |

* cited by examiner

*Primary Examiner*—Anita K Alanko
(74) *Attorney, Agent, or Firm*—Luedeka, Neely & Graham PC

(57) ABSTRACT

A method of substantially simultaneously forming at least two fluid supply slots through a thickness of semiconductor substrate from a first surface to a second surface thereof. The method includes the steps of applying a photoresist layer to the first surface of the semiconductor substrate. The photoresist layer is patterned and developed using a gray scale mask for a first fluid supply slot. The semiconductor substrate is then reactive ion etched, to form the at least two fluid supply slots through the thickness of the substrate. The first fluid supply slot is substantially wider than the second fluid supply slot, and the first and second fluid supply slots are etched through the substrate at substantially the same rate.

10 Claims, 13 Drawing Sheets

METHODS OF DEEP REACTIVE ION ETCHING

FIELD OF THE DISCLOSURE

The disclosure relates to micro-fluid ejection device structures and in particular to methods of forming multiple fluid supply slots having different dimensions in a single semiconductor substrate.

BACKGROUND

Micro-fluid ejection devices continue to be used in a wide variety of applications, including ink jet printers, medical delivery devices, micro-coolers and the like. Of the uses, ink jet printers provide, by far, the most common use of micro-fluid ejection devices. Ink jet printers are typically more versatile than laser printers for some applications. As the capabilities of ink jet printers are increased to provide higher quality images at increased printing rates, fluid ejection heads, which are the primary printing components of ink jet printers, continue to evolve and become more complex.

Improved print quality requires that the ejection heads provide an increased number of ink droplets. At the same time, there is a need to reduce the size of such ejection heads. For some applications, such as color ink jet printing, it is beneficial to have a multi-function ejection head. Such multi-function head may include multiple fluid supply slots for ejecting different fluids, for example, different color inks. Each of the fluids or inks may have different flow characteristics. Accordingly, the fluid supply slots for different fluids typically have different widths.

The manufacture of multiple slots having different widths in a semiconductor substrate is difficult to achieve during a reactive ion etching process. Fluid supply slots having drastically different widths exhibit drastically different etch characteristics, affecting both etch rate and etch profile. Typically, the wider the feature etched in a semiconductor substrate, the faster the etch rate and the more re-entrant the wall angle of the feature. Accordingly, fluid supply slots having larger widths are finished etching before narrower fluid supply slots. The larger the size disparity between the fluid supply slot widths, the more severe the disparity in etch rates and etch profiles. For example, a black ink may require a fluid supply slot having a width of 350 microns, whereas fluid supply slots for cyan, magenta, and yellow inks may have a width of 210 microns. Such a wide disparity is fluid supply slot widths makes simultaneous etching of such fluid supply slots extremely difficult.

With regard to the above, there continues to be a need for smaller ejection heads having increased functionality and improved processes for making micro-fluid ejection heads.

SUMMARY OF THE INVENTION

With regard to the foregoing and other objects and advantages there is provided a method of substantially simultaneously forming at least two fluid supply slots through a thickness of semiconductor substrate from a first surface to a second surface thereof. The method includes the steps of applying a photoresist layer to the first surface of the semiconductor substrate. The photoresist layer is patterned and developed using a gray scale mask for a first fluid supply slot. The semiconductor substrate is then reactive ion etched, to form at least two fluid supply slots through the thickness of the substrate. The first fluid supply slot is substantially wider than the second fluid supply slot, and the first and second fluid supply slots are etched through the substrate at substantially the same rate.

In another embodiment there is provided a method of substantially simultaneously forming at least two fluid supply slots through a thickness of semiconductor substrate from a first surface to a second surface thereof. The method includes the steps of providing a first layer of oxide on the first surface of the semiconductor substrate for a first fluid supply slot and a second layer of oxide on the first surface of the semiconductor substrate for a second fluid supply slot. The first layer of oxide is thicker than the second layer of oxide. A photoresist layer selected from positive and negative photoresist materials is applied to the first surface of the semiconductor substrate. The photoresist layer is patterned and developed using a gray scale mask for the first fluid supply slot. The semiconductor substrate is then reactive ion etched to form at least two fluid supply slots through the thickness of the substrate. The first fluid supply slot is substantially wider than the second fluid supply slot, and the first and second fluid supply slots are etched through the substrate at substantially the same rate.

An advantage of exemplary embodiments of the disclosure can be that a semiconductor substrate having fluid supply slots of different widths can be etched through the substrate at substantially the same etch rate while maintaining suitable wall angles for the etched slots. The formation of semiconductor substrates having multiple slots of different widths enables the substrates to be used for multiple fluids, such as inks, having different liquid flow properties. Exemplary embodiments can also enable such multi-fluid substrates to be made smaller than substrates having multiples slots for multiple fluids wherein the slots all have the same width.

BRIEF DESCRIPTION OF THE DRAWINGS

Further advantages of the disclosed embodiments will become apparent by reference to the detailed description of exemplary embodiments when considered in conjunction with the following drawings illustrating one or more non-limiting aspects of the embodiments, wherein like reference characters designate like or similar elements throughout the several drawings as follows.

DETAILED DESCRIPTION OF THE EXEMPLARY EMBODIMENTS

Figure 1:
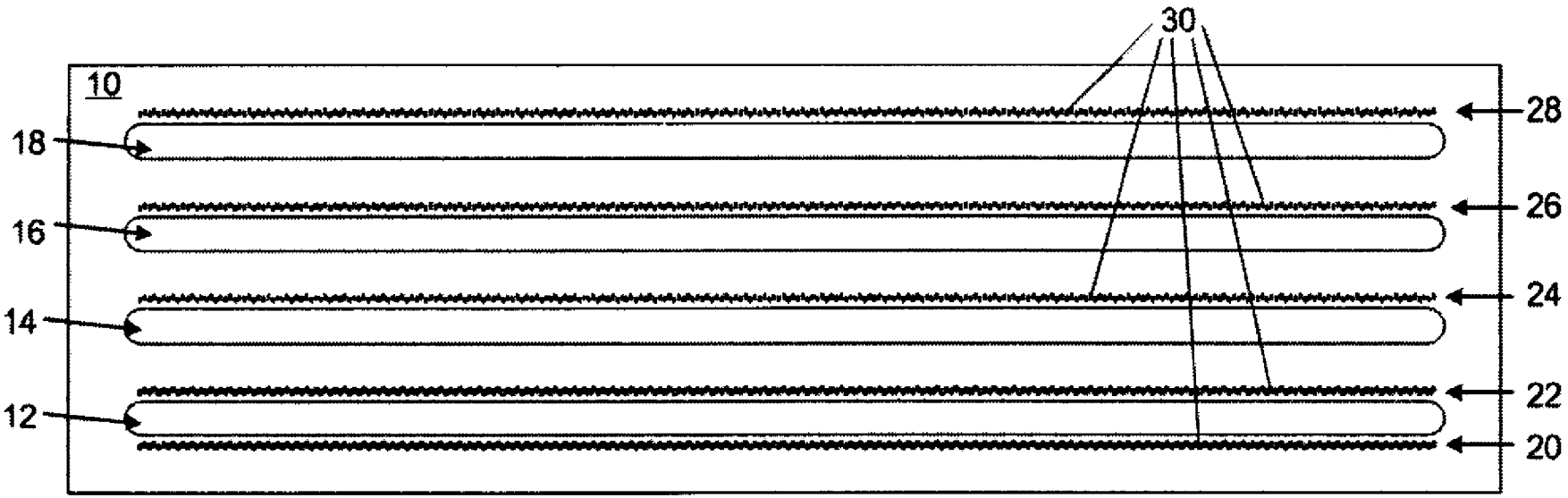
FIG. 1 is a plan view, not to scale, of a substrate for a micro-fluid ejection head containing multiple fluid supply slots.

With reference to FIG. 1, there is shown a plan view, not to scale, of a semiconductor substrate 10 containing multiple fluid supply openings or slots 12, 14, 16, and 18 and arrays 20, 22, 24, 26, and 28 of ejector actuators 30 adjacent the slots 12, 14, 16, and 18. Slot 12 has arrays 20 and 22 of ejectors 30 disposed on both sides thereof while slots 14, 16, and 18 have ejectors 30 disposed only on one side thereof. Accordingly, more fluid may be required to flow through the slot 12 than through the slots 14, 16, and 18. When the substrate 10 is used in an ink jet printer, typically slot 12 will provide black ink to the ejectors arrays 20 and 22 and slots 14, 16, and 18 will provide cyan, magenta, and yellow inks to ejector arrays 24, 26, and 28 respectively. Accordingly, for the substrate 10, slot 12 may be larger in width than slots 14, 16, and 18.

Figure 2:
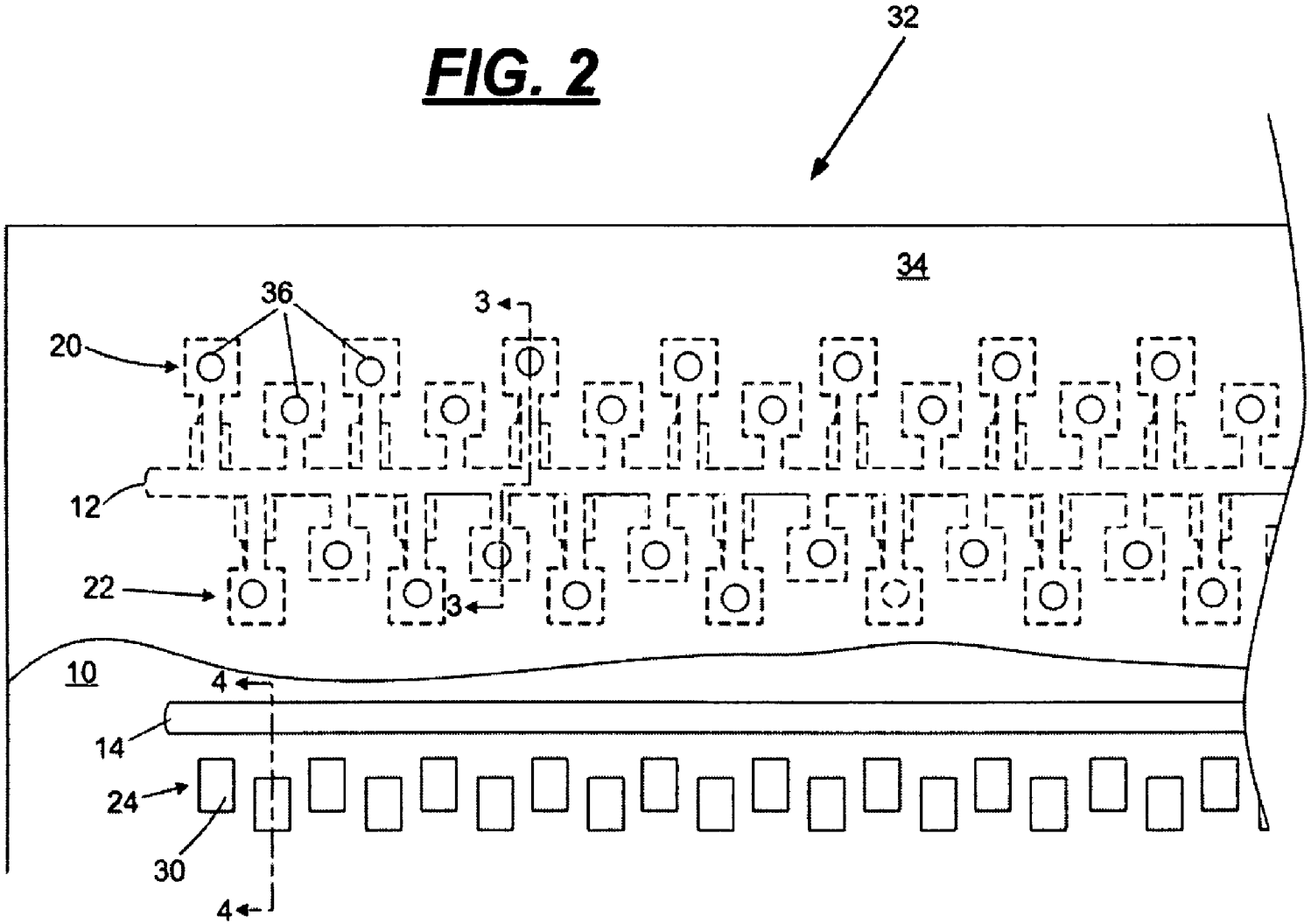
FIG. 2 is a partial plan view, not to scale, of a portion of a micro-fluid ejection head containing multiple fluid supply slots.
Figure 3:
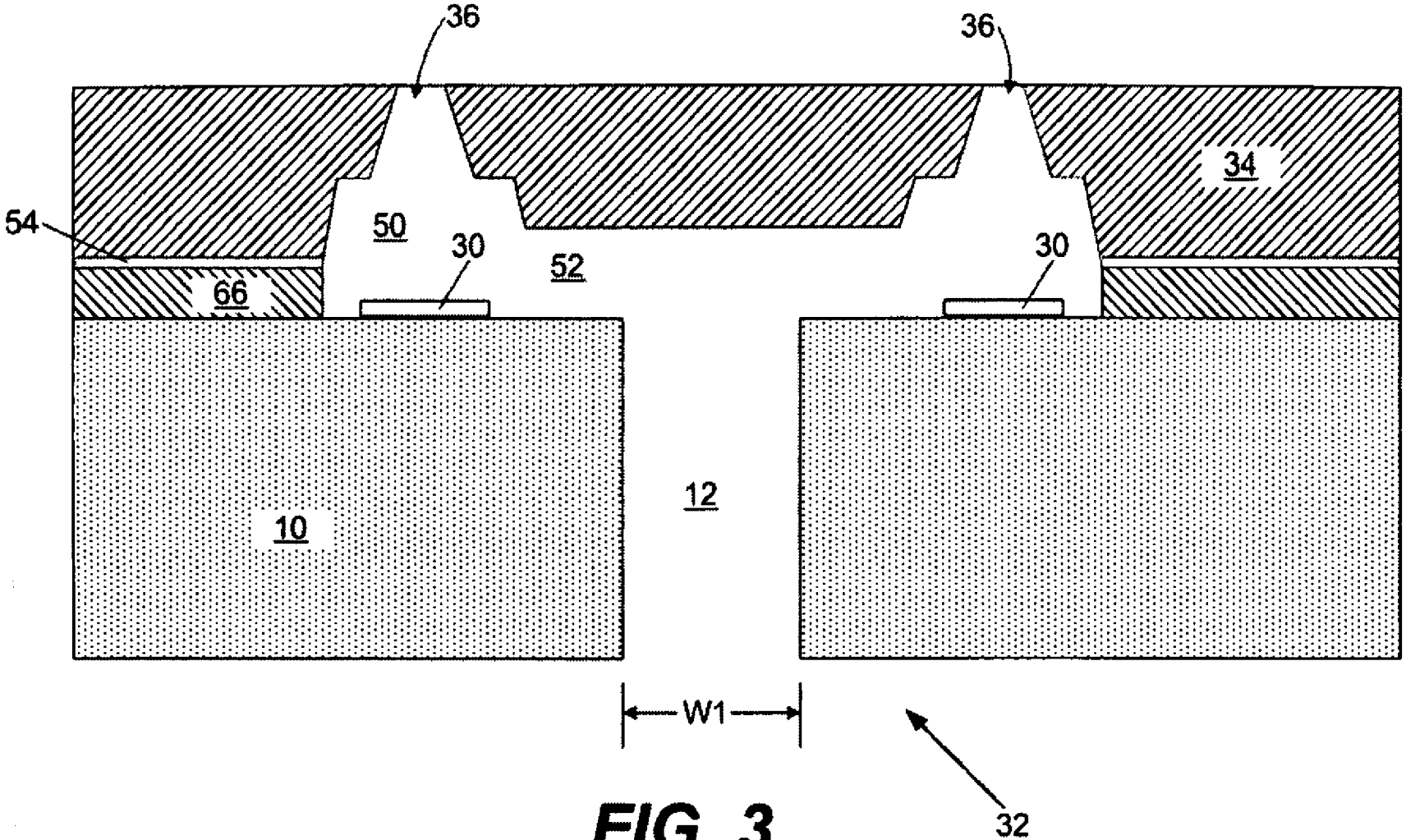
FIGS. 3 and 4 are cross-sectional views, not to scale, of portions of the micro-fluid ejection head of FIG. 2.
Figure 4:
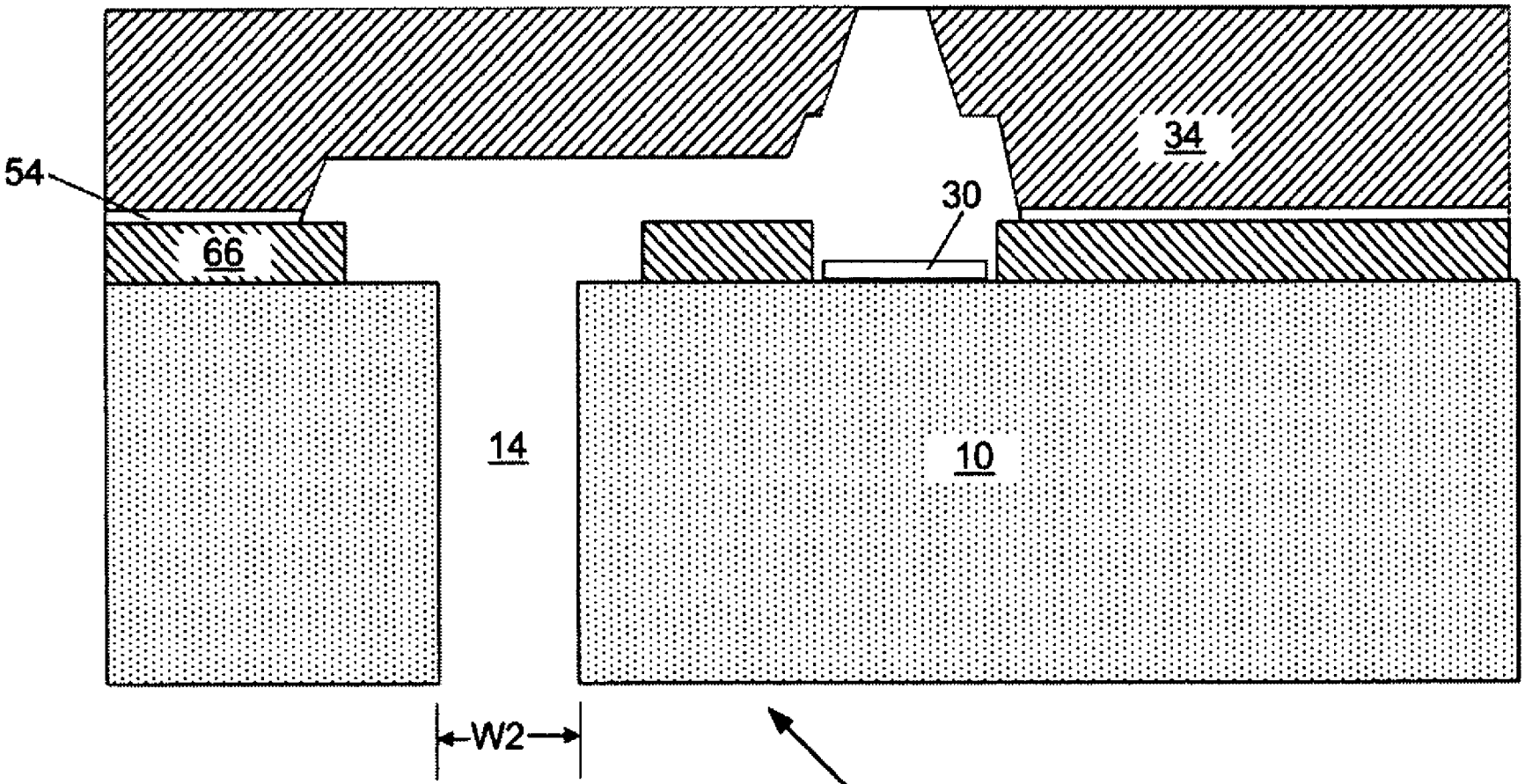

An enlarged partial view, not to scale, of a micro-fluid ejection head 32 using substrate 10 is illustrated in FIGS. 2-4. FIG. 2 is a plan view of ejection head 32 containing substrate 10 and a nozzle plate 34. The nozzle plate 34 contains nozzle holes 36 corresponding to the arrays of ejectors 30 disposed adjacent slot 12. A cross-sectional view, not to scale, of a portion of the ejection head 32 for ejector arrays 20 and 22 is shown in FIG. 3. Likewise a cross-sectional view, not to scale, of a portion of the ejection head for ejector array 24 is illustrated in FIG. 4. It will be appreciated that width W1 of slot 12 is preferably greater than width W2 of slot 14.

Figure 5:
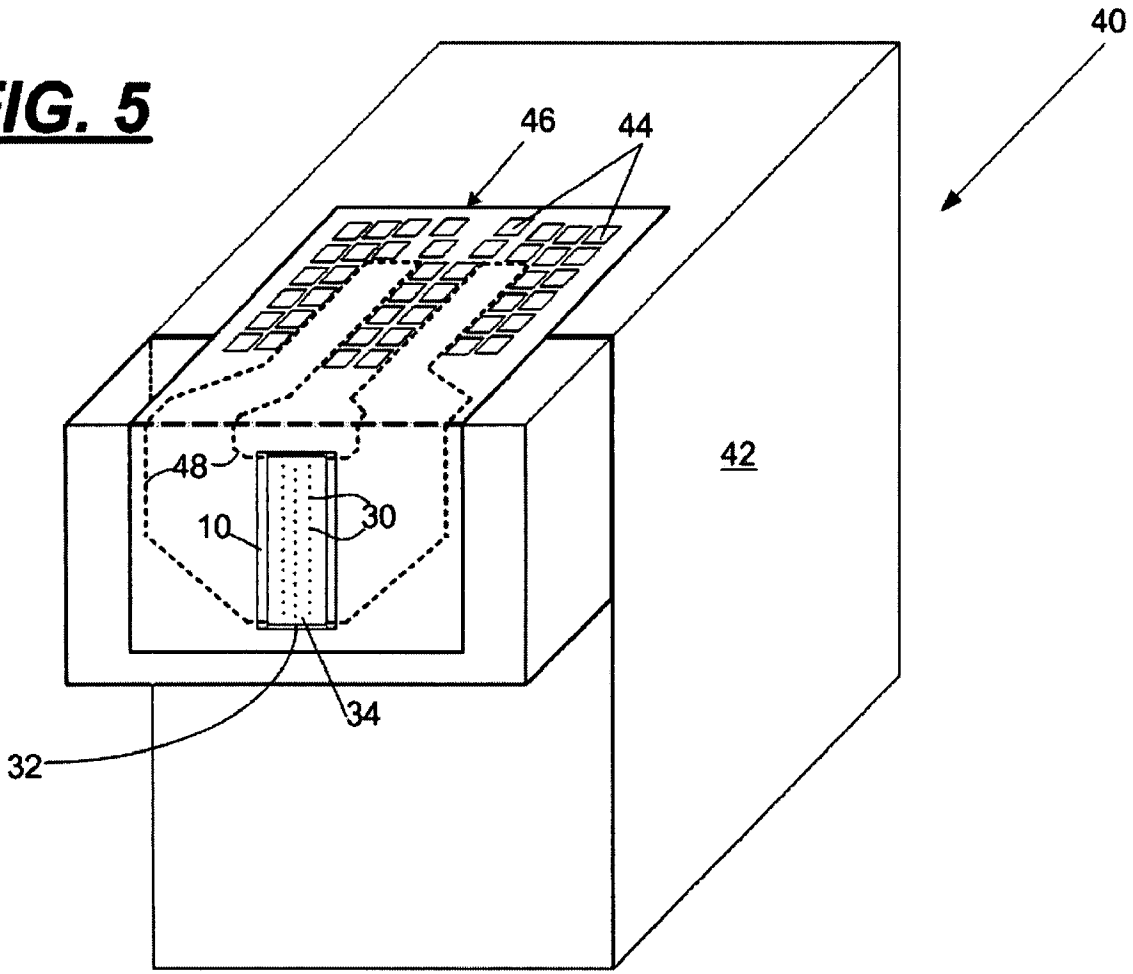
FIG. 5 is a perspective view, not to scale, of a fluid cartridge containing a micro-fluid ejection head as described herein.

Fluid for ejection by ejector arrays 20-28 may be provided by attaching the ejection head 32 to a fluid supply cartridge. A typical fluid supply cartridge 40 is illustrated in FIG. 5. The cartridge 40 includes a cartridge body 42 for supplying a fluid such as ink to the ejection head 32. The fluid may be contained in a storage area in the cartridge body 42 or may be supplied from a remote source to the cartridge body 42.

As described above, the micro-fluid ejection head 32 includes the semiconductor substrate 10 and the nozzle plate 34 containing nozzle holes 36 attached to the substrate 10. Electrical contacts 44 are provided on a flexible circuit 46 for electrical connection to a device for controlling the ejection actuators 30 on the ejection head 32. The flexible circuit 46 includes electrical traces 48 that are connected to the substrate 10 of the ejection head 32.

With reference again to FIG. 3, fluid, such as ink, for ejection through nozzle holes 36 is provided to a fluid chamber 50 through the slot 12 in the substrate 10 and subsequently through a fluid supply channel 52 connecting the slot 12 with the fluid chamber 50. The nozzle plate 34 is adhesively attached to the substrate 10 as by adhesive layer 54.

Figure 6:
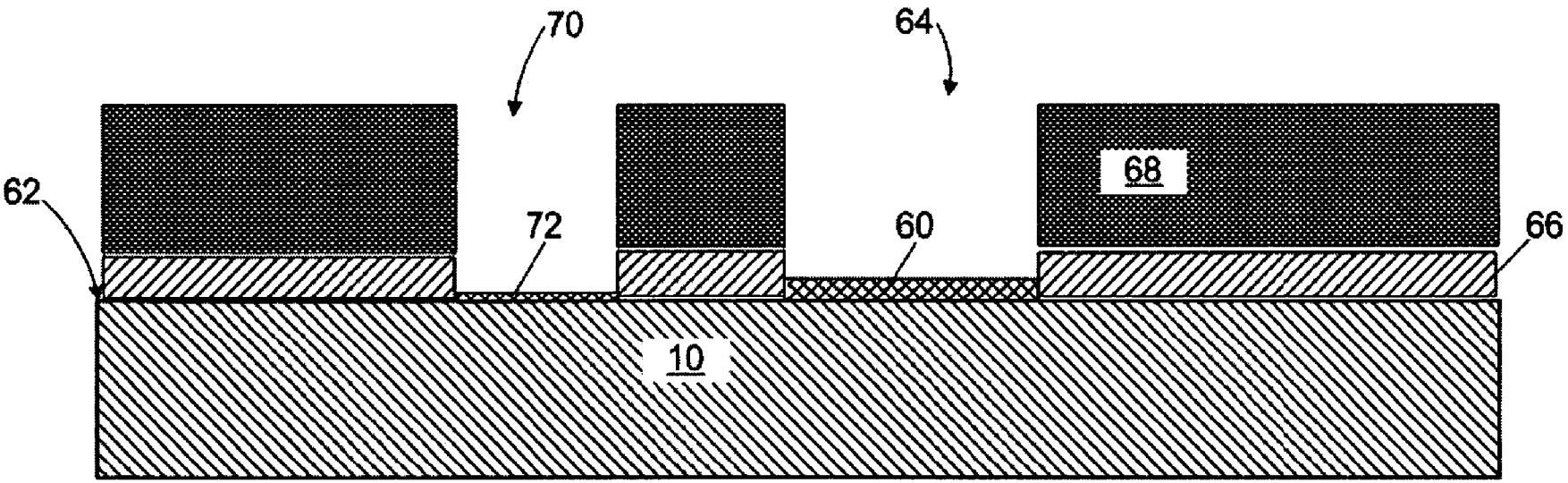
FIG. 6 is a cross-sectional view, not to scale, of a portion of a substrate containing multiple width fluid supply slots therein and an etching mask for forming the fluid supply slots.

One method for forming slots 12 and 14 of different widths involves strategically decreasing the initial etch rate of the wider slot 12. The initial etch rate of slot 12 may be decreased, for example, by leaving a prescribed amount of oxide 60 adjacent a substrate surface 62 in an area 64 designated for etching fluid supply slot 12 in the substrate 10 as shown in FIG. 6. The area 64 is defined by patterning and developing photoresist materials 66 and 68 on the surface of the substrate 10. Area 70 designated for etching fluid supply slot 14 preferably contains less oxide 72 than area 64. The particular amount of oxide 60 and 72 may be selected to allow both the relatively wide slot 12 and relatively narrower slot 14 to be etched through the substrate at substantially the same rate. Typically oxide 60 may have a thickness of up to about 2 microns, and oxide 72 may have a thickness ranging from about 0 up to about 1 micron.

An algorithm for obtaining initial oxide thickness is set forth in relationship (I) as follows:

$$t_{12} = \frac{z_{60}}{\frac{dz}{dt_{60}}} + \frac{z_{10}}{\frac{dz}{dt_{12}}} \text{ and } t_{14} = \frac{z_{10}}{\frac{dz}{dt_{14}}} \tag{I}$$

wherein $t_{12}$ is the etching time needed for forming fluid supply slot 12 completely through substrate 10, $t_{14}$ is the etching time needed for forming fluid supply slot 14 completely through substrate 10, $Z_{60}$ is the thickness of oxide layer 60, $Z_{10}$ is the thickness of the substrate 10, $dz/dt_{60}$ is the oxide etch rate in area 64, $dz/dt_{12}$ is the substrate etch rate for fluid supply slot 12, and $dz/dt_{14}$ is the substrate etch rate for fluid supply slot 14.

In order for the etching time $t_{12}$ for slot 12 to equal the etching time $t_{14}$ for slot 14, the following calculation may be made as shown in relationships (II):

$$\frac{z_{60}}{\frac{dz}{dt_{60}}} = \frac{z_{10}}{\frac{dz}{dt_{14}}} - \frac{z_{10}}{\frac{dz}{dt_{12}}} \text{ therefore } z_{60} = \frac{dz}{dt_{60}}\left(\frac{z_{10}}{\frac{dz}{dt_{14}}} - \frac{z_{10}}{\frac{dz}{dt_{12}}}\right) \tag{II}$$

In the foregoing relationships (I) and (II), it is assumed that the oxide etch rate ($dz/dt_{60}$) is roughly constant for relatively thin films. However, the etch rate ($dz/dt_{12}$) of the substrate 10 is inversely proportional to etch depth in the substrate 10 and varies accordingly. For a silicon substrate 10 and a silicon dioxide oxide layer 60, the ratio of silicon etch rate to silicon dioxide etch rate is about 140:1. Consequently, for an average silicon etch rate of 10 microns/min for the smaller feature or slot 14 and 15 microns/min for the larger feature or slot 12, an oxide layer 60 thickness of 1.78 microns may be required to enable simultaneous completion through a 500 micron thick substrate 10.

As will be appreciated, the actual thickness calculations will depend on processes, which vary both radially and azimuthally across the surface of the substrate 10 during an etch process. Other factors to consider include micro-loading effects and the impact of ramped processes on features whose silicon etching fronts initiate at different parameter regimes.

Figure 7:
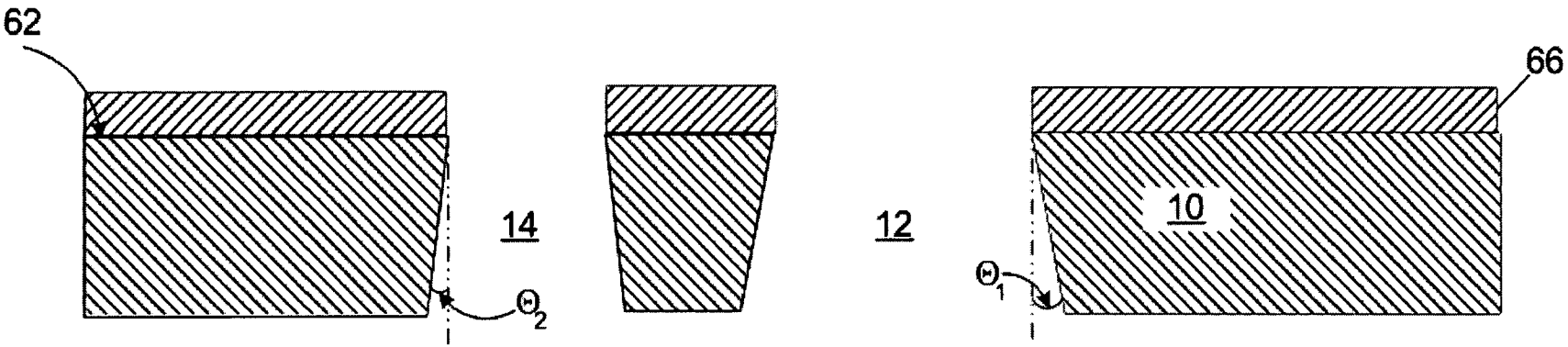
FIG. 7 is a cross-sectional view, not to scale, of a portion of a micro-fluid ejection head made using the etching mask of FIG. 6.

While the foregoing procedure illustrated in FIG. 6 may provide similar etch rates for supply slots 12 and 14 having different widths, using a conventional mask to produce the slot 12 with a larger width than slot 14 may result in slot 12 having a significantly larger wall angle than slot 14. For example, as shown in FIG. 7, angle $\Theta_1$ for fluid supply slot 12 is greater than angle $\Theta_2$ for fluid supply slot 14. It may be possible to reduce the angle $\Theta_1$ for wider fluid supply slot 12 using a gray scale imaging process as described with reference to FIGS. 8-19, while still preserving a comparable etch rate to slot 14.

Figure 8:
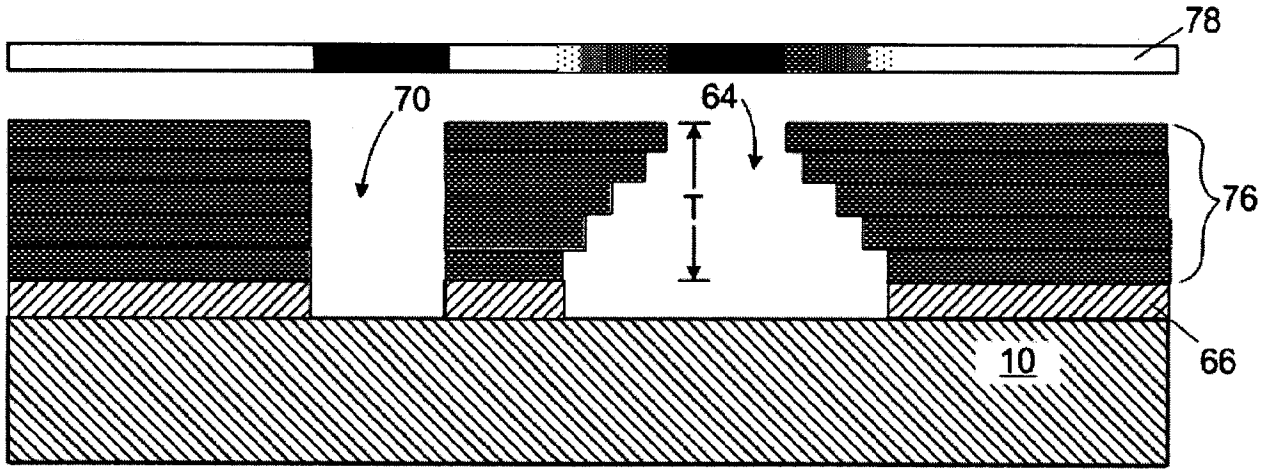
FIGS. 8-13 are cross-sectional views, not to scale, of portions of a substrate and a etching mask for etching the substrate according to one embodiment of the disclosure.
Figure 9:
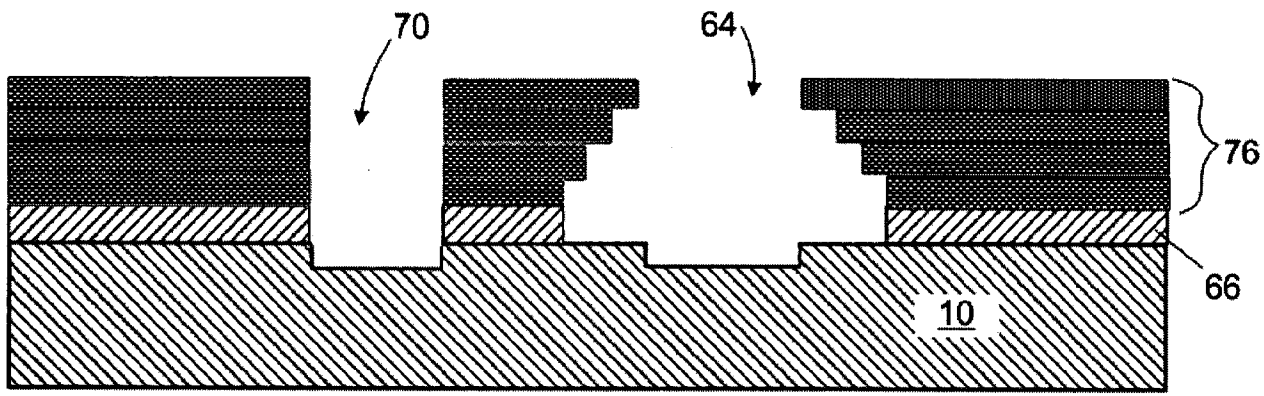
Figure 10:
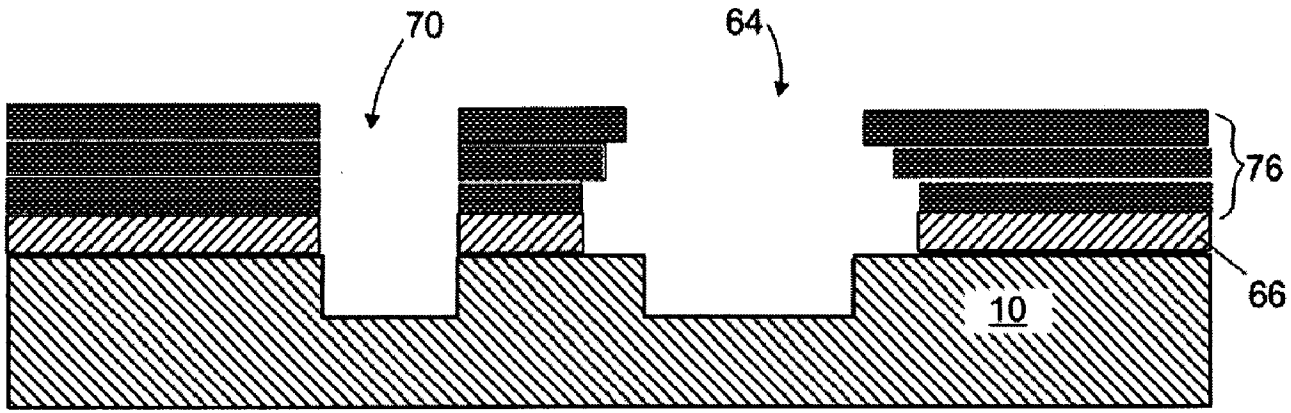
Figure 11:
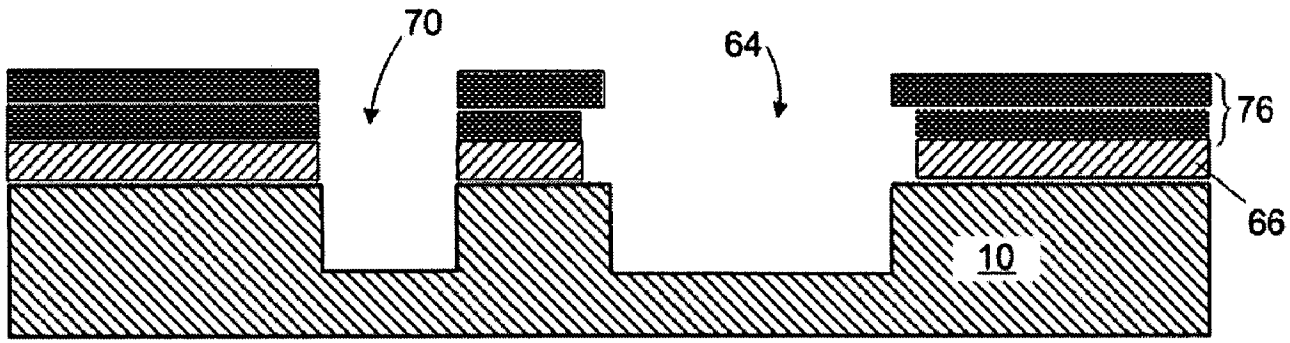
Figure 12:
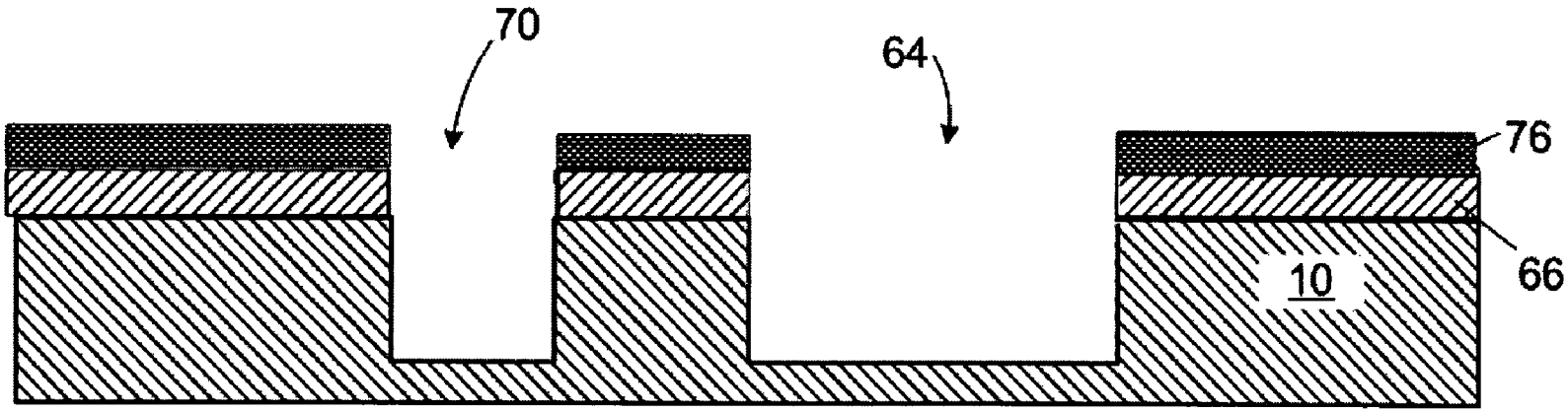

In FIG. 8, a negative photoresist material 76 is applied as a etch mask layer to the photoresist layer 66. The negative photoresist material 76 is imaged using a gray scale photo mask 78 that provides a variable width of the photoresist material 76 through the thickness T of the photoresist material 76 in the area 64 when the photoresist material 76 is developed. Accordingly, area 64 initially provides a relatively narrow opening for plasma etching of the substrate 10. As the etching process progresses through the substrate, the slot 12 becomes wider as the etch mask is etched away as shown in FIGS. 8-13.

Figure 13:
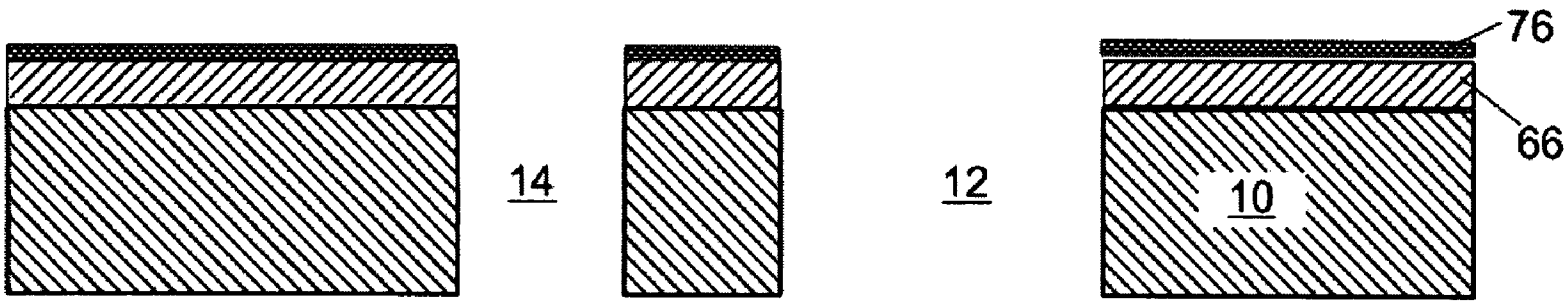

As shown in FIG. 13, a portion of the etch mask 76 may remain on the photoresist layer 66 after completion of the fluid supply slots 12 and 14. Such remaining etch mask 76 may be removed from the photoresist layer 66 and substrate 10 by conventional chemical or physical means. Ideally, the amount of etch mask 76 remaining on the photoresist layer 66 is minimized so that removal of any remaining etch mask 76 may proceed rapidly.

Since the fluid supply slot 12 width W1 gradually increases as a function of etch mask 76, there may or may not be a need for oxide in this embodiment to achieve an etch rate for slot 12 that is substantially the same as the etch rate for slot 14. Another benefit of the embodiment is that it may provide a method for controlling the angle $\Theta_1$ for slot 12.

Figure 14:
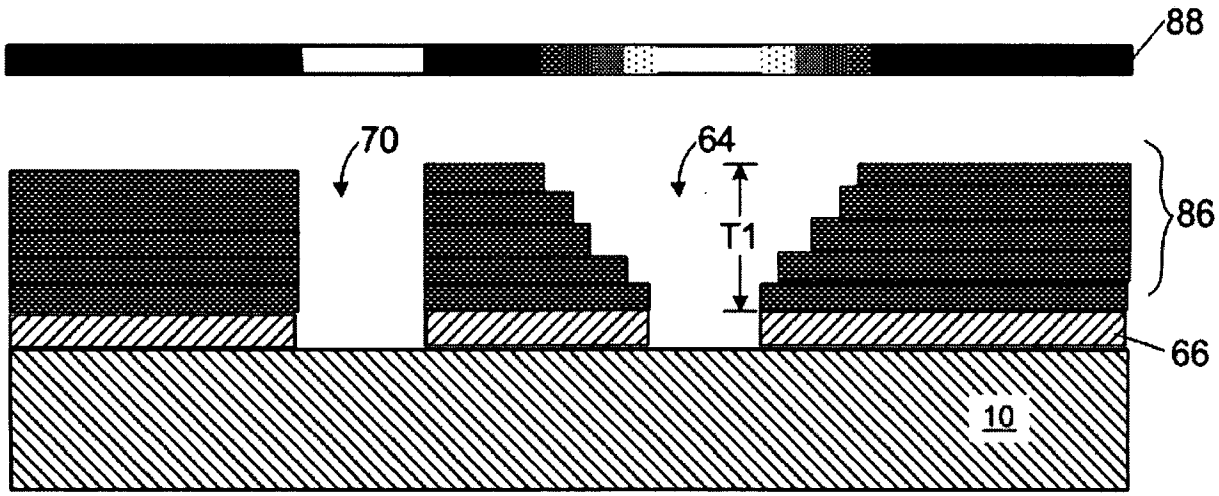
FIGS. 14-19 are cross-sectional views, not to scale, of portions of a substrate and an etching mask for etching the substrate according to another embodiment of the disclosure.
Figure 15:
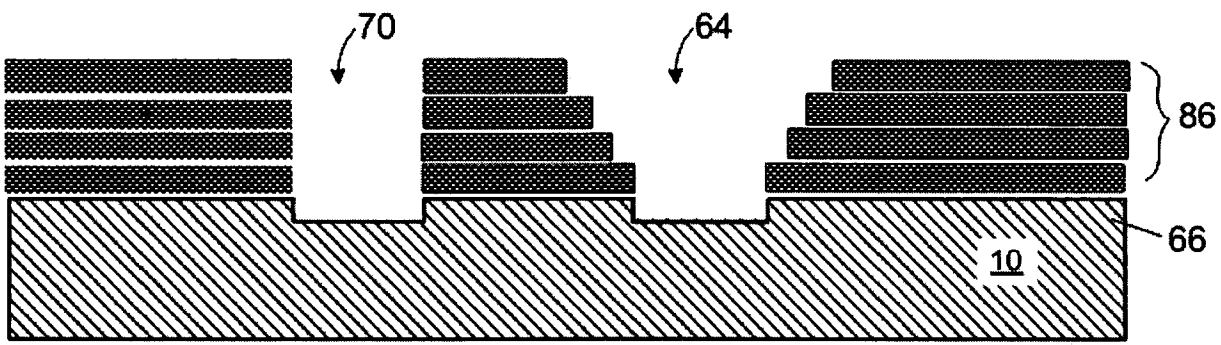
Figure 16:
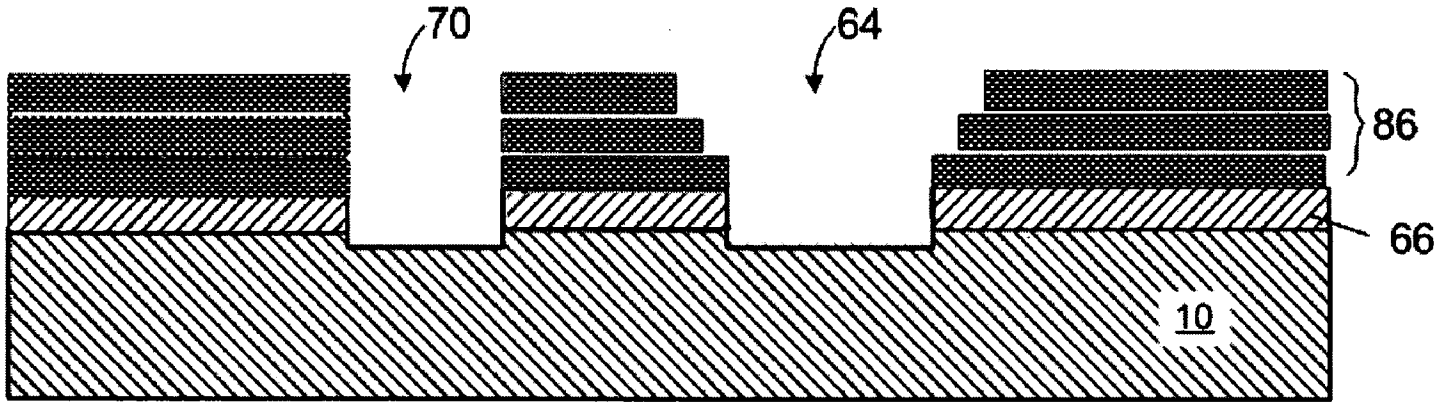
Figure 17:
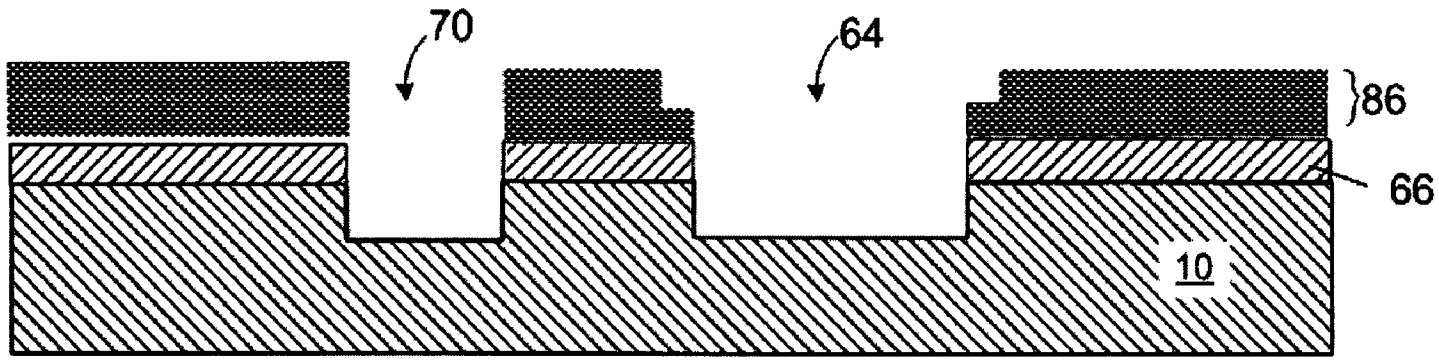
Figure 18:
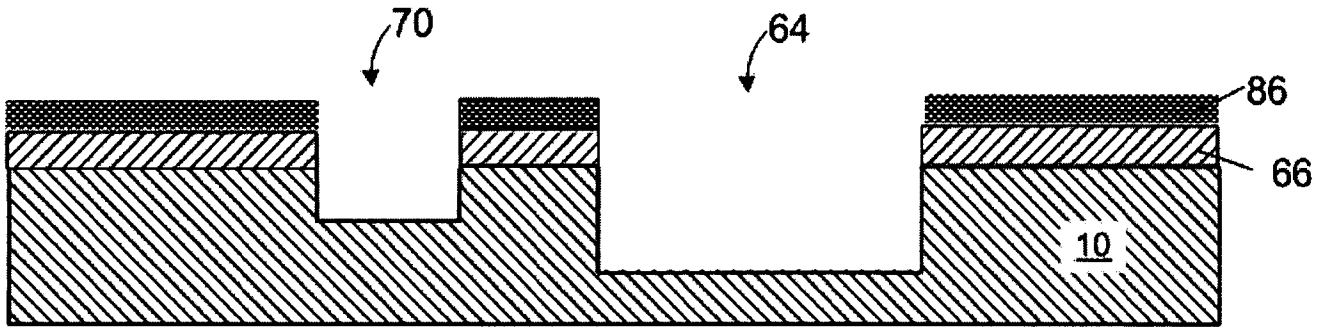
Figure 19:
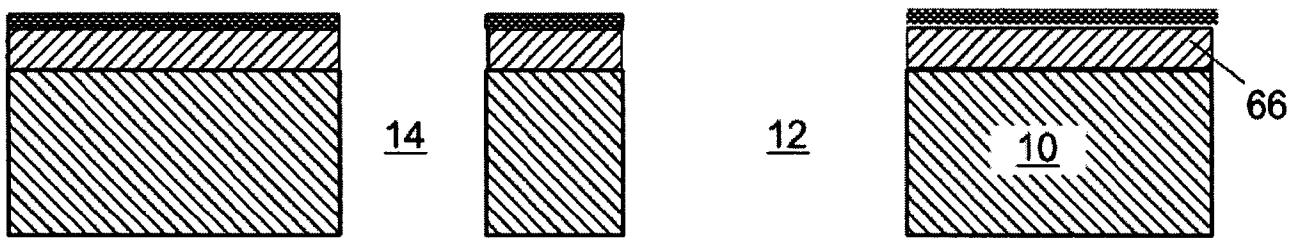

In an alternative embodiment, illustrated in FIG. 14, a positive photoresist material 86 may be applied to the photoresist layer 66 as an etch mask. As before, the positive photoresist is imaged using a gray scale mask 88 to provide a variable width of the photoresist material 86 through the thickness T1 of the photoresist material 86 in the area 64 when the photoresist material 86 is developed.

As the etching process progresses through the substrate, the slot 12 becomes wider as the etch mask is etched away as shown in FIGS. 15-19. As opposed to the embodiment of 8-13, the use of the positive photoresist material 86 as the etching mask may prevent etching of the full width of area 64 adjacent substrate 10 (FIG. 8) at unintended intermediate times. Methods for calculating and setting the desired etching masks 76 and 86 by exposure to gray scale photo masks 78 and 88 are similar to the methods for selecting an oxide thickness for substantially equivalent etch rates described above with reference to relationships (I) and (II).

In summary, the embodiments described herein are intended to facilitate the etching of substrates 10 to provide slots 12 and 14 therein with disparate widths using a reactive ion or plasma etching process such as deep reactive ion etching (DRIE). The ability to form such slots 12 and 14 in a single substrate at substantially the same etching rate enables the juxtapositioning of fluid ejectors for different fluids, such as color and mono ink jet ejectors on the same substrate 10. Since the fluid slots 12 and 14-18 need not be equivalent, as was formerly the case, the embodiments described herein also enable substrate cost savings by providing an increase in the number of substrates having multiple width slots that can be made from a single silicon wafer.

It is contemplated, and will be apparent to those skilled in the art from the preceding description and the accompanying drawings, that modifications and changes may be made in the embodiments of the disclosure. Accordingly, it is expressly intended that the foregoing description and the accompanying drawings are illustrative of preferred embodiments only, not limiting thereto, and that the true spirit and scope of the present disclosure be determined by reference to the appended claims.

What is claimed is:

1. A method of substantially simultaneously forming at least two fluid supply slots through a thickness of substrate from a first surface to a second surface thereof, comprising the steps of:

applying a photoresist layer to the first surface of the substrate;

patterning and developing the photoresist layer using a gray scale mask to provide a variable width through a thickness of the photoresist layer for forming a first fluid supply slot, and an essentially constant width through the thickness of the photoresist layer for forming a second fluid supply slot; and reactive ion etching the substrate to form the at least two fluid supply slots through the thickness of the substrate, wherein a width of the first fluid supply slot is greater than a width of the second fluid supply slot, and the first and second fluid supply slots are etched through the substrate at substantially the same rate.

2. The method of claim 1, wherein three or more fluid supply slots are etched through the thickness of the substrate, wherein the three or more supply slots each have widths that are less than the width of the first fluid supply slot.

3. The method of claim 1, wherein the photoresist layer is a positive acting photoresist layer.

4. The method of claim 1, wherein the photoresist layer is a negative acting photoresist layer.

5. The method of claim 1, further comprising the steps of:

maintaining an amount of a first oxide layer on the first surface of the substrate for the first fluid supply slot; and maintaining an amount of a second oxide layer less than the first oxide layer on the first surface of the semiconductor substrate for the second fluid supply slot prior to etching the slots through the thickness of the substrate.

6. A method of substantially simultaneously forming at least two fluid supply slots through a thickness of a substrate from a first surface to a second surface thereof, the method comprising the steps of:

providing a first layer of an oxide on the first surface of the substrate for a first fluid supply slot and a second layer of an oxide on the first surface of the substrate for a second fluid supply slot, wherein the first layer of oxide is thicker than the second layer of oxide;

applying a photoresist layer selected from positive and negative photoresist materials to the first surface of the substrate;

patterning and developing the photoresist layer using a mask for the first fluid supply slot and the second fluid supply slot; and reactive ion etching the substrate to form the at least two fluid supply slots through the thickness of the substrate, wherein the first fluid supply slot is substantially wider than the second fluid supply slot, and the first and second fluid supply slots are etched through the substrate at substantially the same rate.

7. The method of claim 6, wherein the steps are sequential.

8. The method of claim 6, wherein three or more fluid supply slots are etched through the thickness of the substrate, wherein the three or more supply slots have widths that are substantially less than the width of the first fluid supply slot.

9. The method of claim 8, wherein the photoresist layer is a positive acting photoresist layer.

10. The method of claim 8, wherein the photoresist layer is a negative acting photoresist layer.

* * * * *